United States Patent [19]

Houriet, Jr. et al.

[11] Patent Number: 4,955,967

[45] Date of Patent: Sep. 11, 1990

[54] ELECTRONICALLY SCORED DART GAME WITH MISSED DART DETECTION SYSTEM

[75] Inventors: John W. Houriet, Jr., Bensalem; James A. Kavanagh, Warminster, both of Pa.

[73] Assignee: Merit Industries, Inc., Bensalem, Pa.

[21] Appl. No.: 465,280

[22] Filed: Jan. 16, 1990

[51] Int. Cl.[5] ..... F41J 5/06

[52] U.S. Cl. ..... 273/372

[58] Field of Search ..... 273/371, 372, 376

[56] References Cited

U.S. PATENT DOCUMENTS 4,129,299 12/1978 Busch ..... 273/372

4,807,887 2/1989 DeVale et al. ..... 273/372

*Primary Examiner*—Benjamin Layno

*Attorney, Agent, or Firm*—Panitch Schwarze Jacobs & Nadel

[57] ABSTRACT

A detection system for detecting darts which have missed the target in an electronically secored dart game is comprised of first audio sensor circuitry located proximate to the dart board target for detecting sounds created when a dart strikes either the dart board target or the housing in the vicinity of the target and generating an electrical signal upon the detection of such sounds. A second audio sensor circuit located remote from the target is employed for detecting sounds that simulate the sounds created when a dart strikes either the target or the housing in the vicinity of the target and for generating an electrical signal upon the detection of such simulated sounds. The outputs from the audio sensor circuitry are compared and an output comparison signal is generated only when a signal is received from the first audio sensor circuit in the absence of a signal from the second audio sensor circuit. The output comparison signal is compared with a score signal output of an electronic scoring circuit and a second output comparison signal indicative of a missed dart is generated only when a first comparison output signal is received in the absence of a score signal.

10 Claims, 5 Drawing Sheets

ELECTRONICALLY SCORED DART GAME WITH MISSED DART DETECTION SYSTEM

BACKGROUND OF THE INVENTION

The present invention relates generally to electronically scored dart games and, more particularly, to an electronically scored dart game which includes means for detecting and appropriately scoring darts which miss the target.

Electronically scored dart games are generally well known in the art and are commercially available from a variety of sources, including Merit Industries, Inc., the assignee of the present invention. Such dart games generally comprise a cabinet or housing with a decorative front surface which includes a specialized target or dart board adapted to receive and capture one or more darts, each having a tip made of flexible plastic with a relatively blunt point. Darts of this type resemble conventional metal tipped darts in appearance, flight characteristics and target striking characteristics, but are much safer in that they are incapable of piercing a person's skin or causing damage to walls or other structures or objects adjacent to the dart game.

To enable such plastic tipped darts to be captured by the dart board or target, the target employed in some prior art dart games is comprised of a plurality of generally vertically extending target plates. The target plates, which are usually formed of a plastic material are arranged in a specific array or pattern which establishes generally arcuate scoring areas, substantially the same as the scoring areas of a traditional dart board used in conjunction with conventional metal tipped darts. Each target plate has a front surface which includes a plurality of generally circular openings sized for receiving and capturing the tip of a plastic tipped dart. Each of the target plates is independently, slidably supported within a surrounding support structure, generally referred to as a "spider," so that when the tip of a dart is received within one of the target plate openings, the force of the moving dart entering the target plate opening results in a force being imposed on the target plate, thereby moving the target plate rearwardly, at least a short distance, with respect to the support structure. Each of the target plates also includes a rear surface which contains one or more electrical contacts for engaging corresponding contacts associated with the support structure and/or housing to generate an electrical signal indicating a score when the target plate slides rearwardly after receiving a dart. Other dart games may employ a different type of target which does not use movable target plates, but which generates an electrical score signal whenever a dart is captured by the target.

An electronic scoring system associated with the dart game senses each such score signal, adds the score for each player and provides an indication of each player's score on a visual display, such as a plurality of lights, light-emitting diodes, cathode ray tube, or the like. The electronic scoring system is generally microprocessor based and includes a program or software for controlling the functioning of the dart game and for providing playing instructions to the dart game players.

When more than one player is playing such an electronically scored dart game, the electronic scoring system must keep track of the number of darts thrown in order to know when one player's turn has been completed and it is time for another player's turn to begin. In this manner, the electronic scoring system can accurately keep track of the score for each of a plurality of players. One way that such an electronic scoring system keeps track of the players is by counting the number of darts which strike the target. For example, in a dart game in which each player is permitted to throw three darts for each turn, the electronic scoring system knows that a first player's turn has been completed when it senses, for example, that three target plates have moved rearwardly, resulting in the generation of three score signals indicating scores. While such a scoring system may be adequate when employed with highly experienced players who are unlikely to miss the target, it is unsatisfactory with most other players in that each player may be permitted to continue to throw a virtually unlimited number of darts at the target for each turn until such time as three scores are made, regardless of the number of darts that completely miss the target.

In order to overcome this scoring problem, there was developed in the prior art a system for determining when a player threw a dart which missed the target. The prior art system utilized a microphone or some other such sound detector located proximate the target, and electronic circuitry for processing sounds picked up by the microphone to provide an electrical 'hit' signal whenever a dart struck either the target or the area surrounding the target proximate the microphone. Utilizing such a detection system, the electronic scoring system was able to determine when three darts were thrown by a player, regardless of whether all or none of the darts actually hit the target, resulting in the generation of a score signal. The scoring system then knew when each player's turn was completed, thereby permitting a more accurately scored dart game.

While the prior art system was generally adequate, it suffered from one major flaw. In addition to detecting a dart striking the target or the area surrounding the target, the sound-activated detection system of the prior art detected certain unrelated but similar sounds in the general area of the dart game. For example, the detection system would detect sounds in the area of the dart game associated with other nearby games, such as pool, ping pong, pinball, etc., as well as other unrelated sounds which were not indicative of a dart striking the target or the area surrounding the target. Thus, with such a prior art system, the electronic scoring system would often react to such extraneous sounds by indicating the completion of a player's turn when fewer than three darts had been thrown, often resulting in the generation of improper scores for one or more of the players.

The present invention overcomes the problems inherent with the prior art detection system by providing a missed dart detection system which includes a plurality of audio detecting means at spaced locations near the target, as well as false event detecting circuitry, to permit the electronic scoring system to discriminate between signals generated by darts striking the target or the area surrounding the target and signals falsely generated as a result of other, extraneous sounds occurring in the area of the dart game.

SUMMARY OF THE INVENTION

Briefly stated, the present invention comprises an improvement to an electronically scored dart game having a housing including a front surface, and a target on the housing front surface. The target includes a plurality of target plates, each target plate having a front surface including a plurality of openings for receiving the tip of a dart and having a rear surface. The target further comprises support means for supporting the target plates, the support means permitting a target plate to move rearwardly when receiving the tip of a dart within one of the openings. Electronic means are provided for sensing the rearward movement of the target plates and for generating a score signal to determine a score in the response thereto. The electronic means includes display means for displaying the score. The improvement of the present invention comprises detector means for detecting when a thrown dart strikes the housing in the vicinity of the target, but does not strike a target plate with sufficient force to move the struck target plate rearwardly for a score (a missed dart). The detection means comprises first audio sensor means located proximate to the target for detecting sounds created when a dart strikes either the target or the housing in the vicinity of the target and for generating an electrical signal upon the detection of such sounds. Second audio sensor means are located remote from the target for detecting sounds that simulate the sounds created when a dart strikes either the target or the housing in the vicinity of the target and for generating an electrical signal upon the detection of such simulated sounds. First comparison means communicating with the first and second audio sensor means are employed for generating an electrical output signal only when an electrical signal is received from the first audio sensor means in the absence of the receipt of an electrical signal from the second audio sensor means. Second comparison means communicating with the output of the first comparison means and with the electronic means is provided for generating an output signal indicative of a missed dart only when an output signal is received from the first comparison means in the absence of a score signal.

BRIEF DESCRIPTION OF THE DRAWINGS

The foregoing summary, as well as the following detailed description of a preferred embodiment of the invention, will be better understood when read in conjunction with the appended drawings. For the purpose of illustrating the present invention, there are shown in the drawings embodiments which are presently preferred. It should be understood, however, that the present invention is not limited to the particular arrangement and instrumentalities shown. In the drawings.

DESCRIPTION OF PREFERRED EMBODIMENTS

Figure 1:
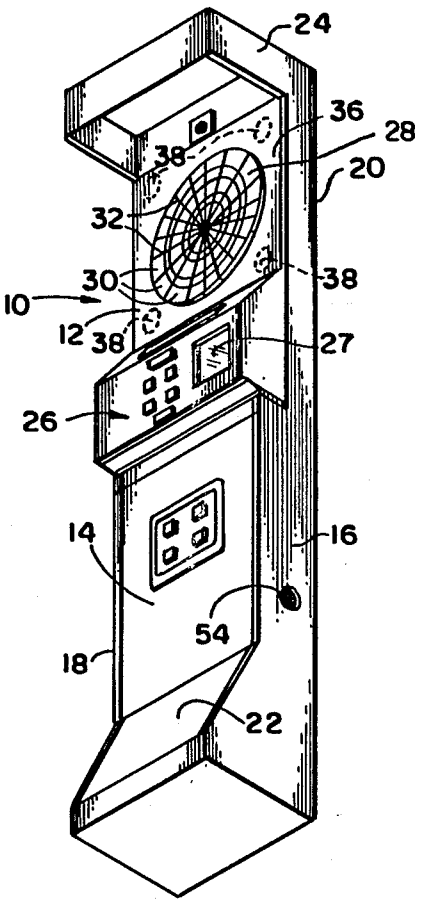
FIG. 1 is a perspective view of an electronically scored dart game in accordance with the present invention.

Referring to the drawings, wherein like numerals indicate like elements throughout, there is shown in FIG. 1 an example of one type of an electronically scored dart game, generally 10. The dart game 10 is comprised of a generally elongated, generally enclosed cabinet or housing 12 having a front surface 14, side surfaces 16 and 18, and a rear surface 20. In the embodiment shown, the lower portion 22 of the housing 12 is preferably at least slightly wider, front to rear, than the upper portion of the housing to provide enhanced stability and to help prevent the housing from tipping over in the forward direction. In general, the rear surface 20 of the housing 12 is placed against a partition or wall surface so there is little likelihood that the housing 12 will tip over in the rearward direction. The upper portion of the housing 12 includes a generally outwardly extending canopy or cover member 24 which, in addition to being employed for identifying the dart game, may include one or more lighting fixtures (not shown) for purposes which will hereinafter become apparent.

The housing front surface 14 also includes a plurality of pushbuttons and lights, shown generally as 26, and a display screen, in the present embodiment a video display screen 27, all of which are employed for interaction between the dart game 10 and the game players. For example, one or more of the buttons may be depressed to indicate to the dart game the number of players involved in a particular game or the type of game to be played. Similarly, the lights and/or the video display 27 may be employed to indicate to the players the order in which the players should be throwing the darts, scoring, as well as messages, such as "Insert Coins," "Game Over," etc.

The primary feature of the upper portion of the housing front surface 14 is the dart board or target, shown generally as 28. In the game illustrated in FIG. 1, the dart board is comprised of a plurality of generally vertically extending, generally arcuate shaped individual target segments or plates 30. Each target plate 30, which preferably is formed of a generally rigid plastic material, has a front surface which includes a plurality of generally circular openings for receiving the tip of a dart (not shown) in a manner which is generally well known in the electronically scored dart game art. Each target plate 30 also has a rear surface (not shown) which contains one or more electrical contacts for engaging corresponding contacts associated with the housing 12 to indicate a score. The dart board or target 28 further comprises support means for supporting the target plates 30 for generally horizontal movement. In the present embodiment, the support means is comprised of a generally circular, rigid support grid or spider 32 which receives and supports the individual target plates 30 in an arcuate array substantially the same as that of a traditional dart board of the type utilized with standard steel tipped darts. The support grid or spider 32 generally surrounds each target plate 30, permitting each target plate to move rearwardly (toward the rear surface 20 of the housing 12) when receiving the tip of a dart within one of the target plate openings. The spider 32 also includes an appropriate stop means in the form of a lip or other structure (not shown) for preventing the target plates 30 from moving beyond the front or forward edge of the spider 32 toward the housing front surface 14.

Figure 5:
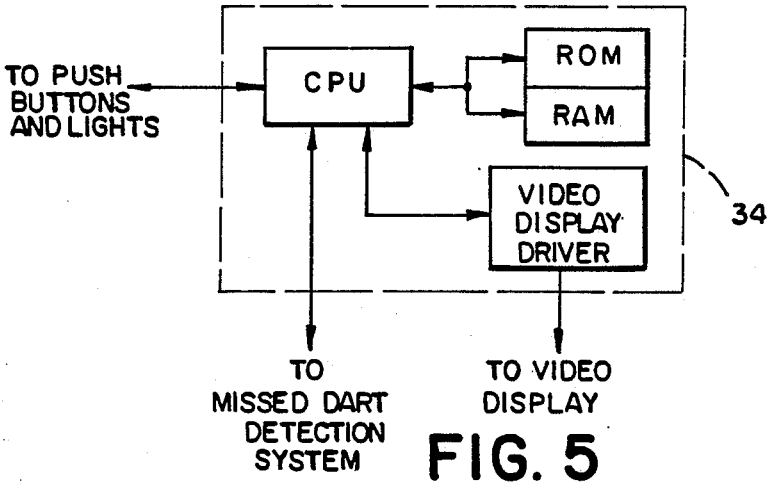
FIG. 5 is a schematic block diagram representation of the electronic scoring system of the dart game shown in FIG. 1.

The interior of the housing 12 includes electronic means or electronic circuitry 34 (see FIG. 5) for sensing the rearward movement of the target plates 30 and for determining a score as a result of such rearward movement. The electronic circuitry is also employed for controlling the operation of the dart game 10, as well as for controlling the action of the pushbuttons and lights 26 and the video display 27. In the present embodiment, the electronic circuitry 34 is a microprocessor based computer system which includes a central processing unit (CPU), memory including random access memory (RAM), and some type of read only memory (ROM), input/output circuitry including a video display driver, and other associated circuitry and/or computer software for controlling and performing the requisite scoring, display, administrative and other functions in a manner which is generally well known in the art.

The electronically scored dart game 10, as thus far described, is well known in the art and is commercially available from a variety of manufacturers, including Merit Industries, Inc., the assignee of the present invention. Further details of the structure and operation of the dart game 10 are not necessary for a complete understanding of the present invention and, therefore, will not be presented herein. Such details are available from the various electronically scored dart game manufacturers. In addition, general information concerning the structure and operation of the target plates may be obtained by referring to U.S. Pat. No. 4,057,251, the disclosure of which is incorporated herein by reference.

It should be appreciated by those skilled in the art that the electronically scored dart game 10, as described above, is only for the purpose of illustrating the structure and operation of the present invention. It should be appreciated that the present invention, while illustrated as being employed in connection with the electronically scored dart game 10, could be employed with any other type of electronically scored dart game. For example, the present invention may be employed in connection with an electronically scored dart game in which the darts may be either plastic-tipped or steel-tipped and in which the scoring signals are generated by the interaction between the dart tips and the target, with no movement of any target segments, target plates, etc. The present invention may also be employed with an electronically scored dart game in which the scoring system other than that illustrated in FIG. 5. For example, the present invention may be employed in an electronically scored dart game in which the scoring system does not employ either a microprocessor or other associated circuitry, but, instead, is completely implemented in hardware utilizing suitable digital logic circuitry of a type well known in the art.

As discussed generally above, the present invention comprises a system for detecting darts which are thrown but which miss the target, thereby resulting in a zero score for such darts. As previously indicated, it is desirable to have such a missed dart detection system so that the score calculated and indicated by the dart game more accurately reflects the actual score. For purposes of the present application, the terms "missed dart" or "miss" shall generally means a dart which is thrown at the target but which either does not hit the target at all or does not properly hit the target with sufficient force to generate a score signal. Thus, for example, a miss may can occur when a dart completely misses the target 28 and strikes the generally square target mounting board 36, the portion of the housing 12 which surrounds and supports the target 28. A miss may also occur when a dart strikes or hits the spider 32 and is not deflected into an opening in a target plate 30 for a score. In connection with the dart game 10 illustrated in FIG. 1, a miss also results if a dart strikes a target plate 30 with a force which is insufficient to move the target plate rearwardly to generate a score signal, even if the dart is captured or held within a target plate opening. In some electronically scored dart games which employ a "catch ring" (not shown in FIG., 1) comprised of a generally annular band surrounding the target 28 for capturing darts which just miss the outer circumference of the target. A miss may occur when a dart strikes or is captured by the catch ring. For purposes of the present discussion, the term "target" or "dart board"0 shall include the target segments or plates 30, the spider 32 and the catch ring, if it is so employed.

In the present or first embodiment, the missed dart detection system is comprised of a first audio sensor means located proximate to the target 28 for detecting sounds created when a dart strikes the target 28 or the target mounting board 36, and for generating a first electrical signal upon the detection of such sounds. In the present embodiment, the first audio sensor means comprises four target mounting board transducers or microphones 38 which are positioned at spaced locations on the target mounting board 36, generally radially outwardly from the radial outer edge of the target 28. Preferably, the microphones 38 are each located on a different quadrant of the target mounting board 36 and are circumferentially spaced around the target about 90° apart, in the manner illustrated in FIG. 1. In the presently preferred embodiment, the microphones 38 are physically located on the rear or inner surface of the target mounting board 36 and hence are shown in phantom in FIG. 1. In the presently preferred embodiment, four microphones 38 are employed so that the area or portion of the target mounting board 36 which must be covered by each microphone is relatively small, thereby permitting the use of less sensitive microphones than employed in the prior art, reducing the possibility of obtaining false readings. However, it will be appreciated by those skilled in the art that a lesser number of microphones, or even a greater number of microphones, may be employed and that the microphones 38 may be positioned at locations other than those illustrated in FIG. 1, without departing from the scope of the present invention. Similarly, it may be desirable to mount one or more such microphones on the front surface of the target mounting board 36, at some other location on or within the housing 12, around the housing, such as on canopy 24, or even on the target 28.

In the presently preferred embodiment, the microphones 38 are of the electret type, having a sensitivity of approximately 6 dB. Microphones of this type are available from a variety of manufacturers, including, for example, from Panasonic, Model No. WM-34BY. Complete details of the structure and operation of the microphones 38 are not necessary for a full understanding of the present invention and, in any event, are available from the manufacturers. Suffice it to say that the microphones 38 generate an electrical signal when a dart strikes the target 28 or the mounting board 36, or any other portion of the housing 12 or other structure in the vicinity of the microphones 38, and that the amplitude of the generated electrical signal is proportional to the amplitude of the sound generated by the dart making the strike and thus is proportional to the distance between the location of the dart strike and a microphone. It will, of course, be appreciated by those skilled in the art that any other suitable type of microphone could alternatively be employed.

Figure 3:
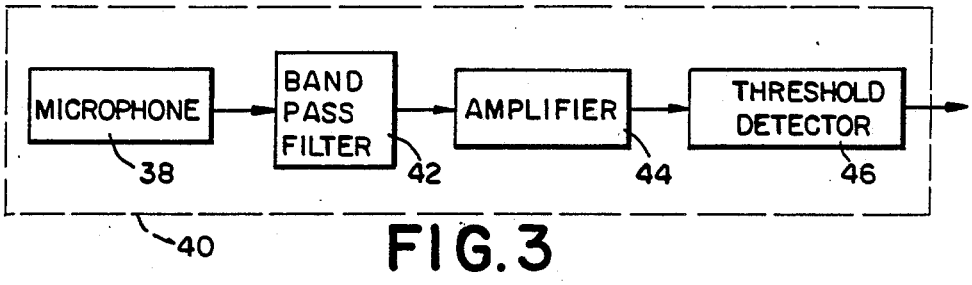
FIG. 3 is a more detailed function block diagram of one detector of the type employed in the system shown in FIG. 2.

As discussed above, the presently preferred embodiment of a missed dart detection system in accordance with the present invention employs four spaced microphones 38. Each of the microphones 38 has associated with it signal conditioning circuitry which, together with the microphone, comprises what will hereinafter be referred to as a detection channel or a "detector." FIG. 3 illustrates a single signal conditioning channel or detector 40, including the microphones 38, a band pass filter 42, an amplifier 44 and a threshold detector 46. The band pass filter 42 receives the electrical signals generated by the microphone 38 as a result of the microphone being exposed to or picking up sound waves, and "passes" only such signals which are within a predetermined frequency range corresponding to the frequency range of sounds expected to be generated by a dart striking the target 28, or the target mounting board 36. In the presently preferred embodiment, the band pass filter 42 is of a specific type which passes frequencies in the frequency range of between 3 KHz and 10 KHz, with all other frequencies received from the microphone 38 being filtered out to ground. It will be appreciated by those skilled in the art that some other suitable frequency range could alternatively be selected for the band pass filter 42.

Electrical signals generated by the microphone 38 with a frequency within the predetermined frequency range are passed by the band pass filter 42 to the amplifier 44. The amplifier 44 is employed for amplifying the signals received from the band pass filter 42. In the presently preferred embodiment, the gain of the amplifier is 20 dB, however, it will be appreciated by those skilled in the art that the amplifier 44 could have some other gain.

The output signal from the amplifier 44 is applied to the input of a threshold detector 46. The threshold detector 46 is of a type well known to those skilled in the art and is employed for becoming active or going high when the input signal received from the amplifier 44 rises above a predetermined minimum voltage, in the present embodiment, three volts. It will be appreciated by those skilled in the art that the band pass filter 42, amplifier 44 and threshold detector 46 may be formed of a series of discrete components or may be part of a single integrated circuit. The specific design of each of these three functional circuits will be readily apparent to one of ordinary skill in the art.

Figure 2:
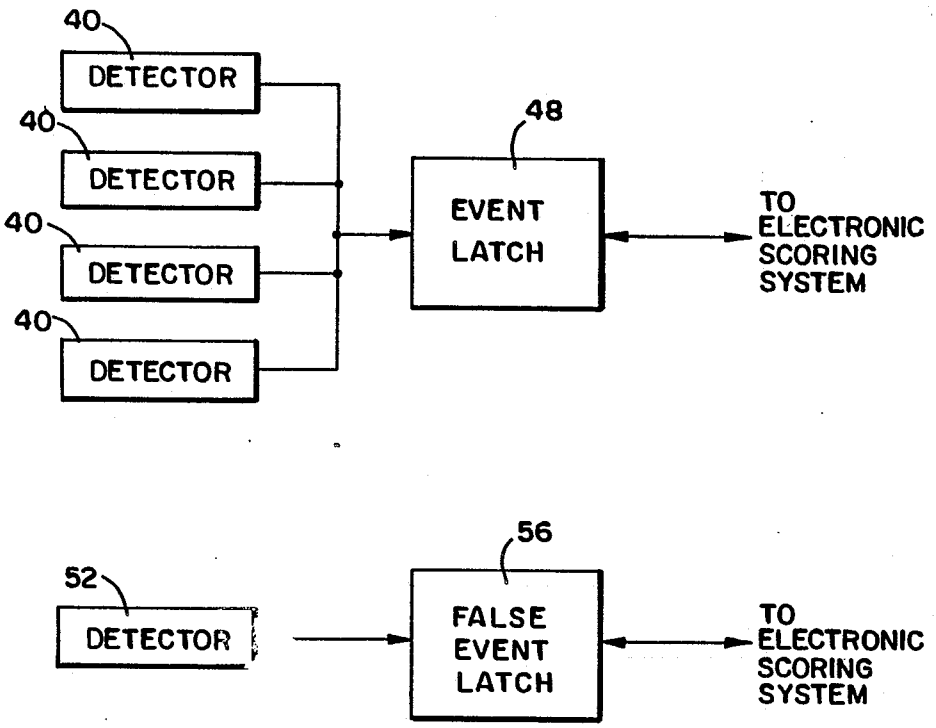
FIG. 2 is a functional block diagram of a missed dart detection system in accordance with a first embodiment of the present invention.

FIG. 2 is a functional block diagram of a first preferred embodiment of a missed dart detection system in accordance with the present invention. As FIG. 2 illustrates, the missed dart detection system is comprised of four separate detection channels or detectors 40, each having a structure as described above in connection with FIG. 3.

Figure 4:
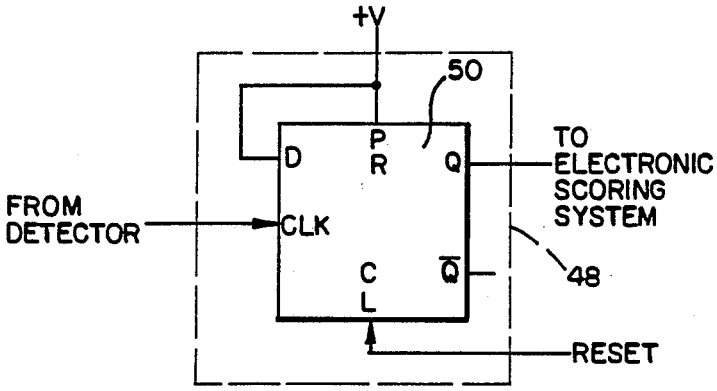
FIG. 4 is a schematic block diagram representation of a latch circuit of the type employed in connection with the system of FIG. 2.

The outputs from each of the detectors 40 (output signal from the threshold detector 46) is applied to a single event latch 48. The event latch 48 is a device which provides an output of a predetermined state upon receipt of an input signal from any one of the four detectors 40. In the first preferred embodiment, the event latch 48 is comprised primarily of a D-type flip-flop 50, illustrated schematically in FIG. 4. A detailed discussion of the structure and operation of flip-flop 50 is not believed to be necessary for a complete understanding of the present invention. Suffice it to say that, upon receipt of a positive going signal from any one of the detectors 40 at its clock terminal (CLK), the D-type flip-flop 50 provides a high or positive voltage signal at its Q output terminal. The Q output terminal of the flip-flop 50 is connected to the electronic scoring system 34 in a manner which permits the scoring system to read the state of the Q output terminal. Once the state of the Q output terminal has been read, the electronic scoring system 34 generates a reset signal which is applied to the clear terminal (CL) of flip-flop 50 to reset the flip-flop output terminals. Thus, a dart striking the target 28 or target mounting board 36, results in the generation of a sound which is picked up one or more of by the microphones 38 and is processed by the detection circuitry associated with the microphones to generate an output signal which, in turn, when applied to the event latch 48, causes the Q output terminal to transition to and remain in an active or high state until read by the electronic scoring system 34 and reset.

The preferred embodiment of the missed dart detection system thus far described is adequate for providing to the electronic scoring system 34 a signal every time a dart strikes the target 28 or the target mounting board 36, in the vicinity or pick-up range of any one or more of the microphones 38. As discussed above, while a missed dart detection system of this type is generally adequate, it contains no provision for false missed dart events which are caused by one or more of the microphones 38 picking up extraneous sounds within the same frequency range of the sounds generated by a dart striking the target 28 or the target mounting board 36. Such sounds could result from other games or sporting activities, such as billiards, ping pong, pinballs, etc. within the general vicinity of the dart game 10. Other ambient or background noise, such as door slams, dishes rattling, jukeboxes operating and certain types of live or recorded music, could also result in the generation of a false event. As previously indicated, a false event could result in a disruption of the dart game, possibly result in improper scoring or an improper indication of the player supposed to be throwing the darts.

In order to overcome the problems which would ordinarily be associated with such a system, the present invention further comprises second audio sensor means located remote from the target 28 for detecting sounds outside of the housing 12 that simulate the sounds created when a dart strikes the target 28 or the target mounting board 36, and for generating a second electrical signal upon the detection of such simulating sounds. The second audio sensor means, in the presently preferred embodiment, is comprised of a detector 52 which is structurally and operationally identical to each of the detectors 40 described above in connection with FIG. 3. However, unlike the above-described detectors 40, the microphone 54 forming a portion of detector 52 is located away from the target 28. In the presently preferred embodiment, as illustrated in FIG. 1, the microphone 54 is preferably positioned on a side surface 16 or 18 of the housing 12, preferably near the floor level. Alternatively, the microphone 54 could be positioned on the front housing surface 14. In addition, unlike the microphones 38 of the detectors 40, microphone 54 is preferably located on an outer surface of the housing 12. In this manner, the microphone 54 picks up ambient sounds in the vicinity of the dart game 10.

The output of the detector 52 is applied to a false event latch 56, which is structurally and functionally identical to event latch 48 described above. As with the event latch 48, the false event latch 56 is electrically connected to the electronic scoring system 34 in a manner which permits the electronic scoring system 34 to read its state and to reset it in substantially the same manner described above in connection with event latch 48. However, unlike event latch 48, the false event latch 56 is only activated if the microphone 54 picks up sounds from the area around the dart game 10 which simulate the sounds which would be picked up by one of the detectors 40. In other words, false event latch 56 is activated only if sounds are generated in the vicinity of the dart game 10 which simulate or sound like the sounds of a dart striking either the target 28 or the target mounting board 36. As with detectors 40, the structure of the detector 52 may vary in a manner known to those skilled in the art.

The missed dart detection system further includes first comparison means communicating with both the first and second audio sensor means for generating an electrical output signal indicative of a missed dart only when a signal is received from the first audio sensor means in the absence of a signal from the second audio sensor means. In other words, if the event latch 48 is activated and the false event latch 56 is not activated, it can be presumed that the event latch 48 was activated as a result of a dart striking either the target mounting board 36, or the target 28, thereby providing a positive indication to the electronic scoring system 34 that a dart has actually been thrown. If, on the other hand, both the event latch 48 and the false event latch 56 are activated, it is assumed that both latches were activated as a result of an external or ambient noise rather than from a dart being thrown. Thus, the electronic scoring system 34 can ignore the indication by the event latch that a dart has been thrown. Of course, the electronic scoring system 34 ignores the activation of the false event latch 56 when the event latch 48 has not been activated. Once the electronic scoring system 34 reads the state of both the event latch 48 and the false event latch 56, each of the latches is reset.

In the first preferred embodiment, the first comparison means is actually implemented in the scoring system 34 by appropriate software, as discussed hereinafter. Alternatively, the first comparison means could be implemented by suitable digital hardware in a manner well known in the art.

While the missed dart detection system thus far described is sufficient to provide an indication with respect to whether a dart either hits or misses, it is not sufficient to determine whether a hit dart has missed or hit a target plate 30. Accordingly, a second comparison means communicating with the output of the first comparison means and with the electronic scoring system 34 is provided for generating an output signal indicative of a missed dart only when an output signal is received from the first comparison means in the absence of a score signal from the electronic scoring system 34. In other words, when the electronic scoring system 34 determines that a dart has been thrown as a result of the event latch 48 being activated in the absence of activation of the false event latch 56, the scoring system 34 determines whether a target plate 30 has been moved to generate a score signal. If a score signal has been generated, then the scoring system 34 knows that the hit occurred on a target plate 30 and the scoring system ignores and resets both latches 48 and 56 and scores the value associated with the particular hit target plate. On the other hand, if the hit established by the event latch 48 does not coincide with a score signal from any of the target plates 30 (in the absence of a false event latch 56 activation), the scoring system 34 knows that a dart was thrown which made a hit, but did not result in a score. Under these circumstances, a zero score is recorded for the thrown dart and the dart count for the particular player is decreased by one.

Figure 6:
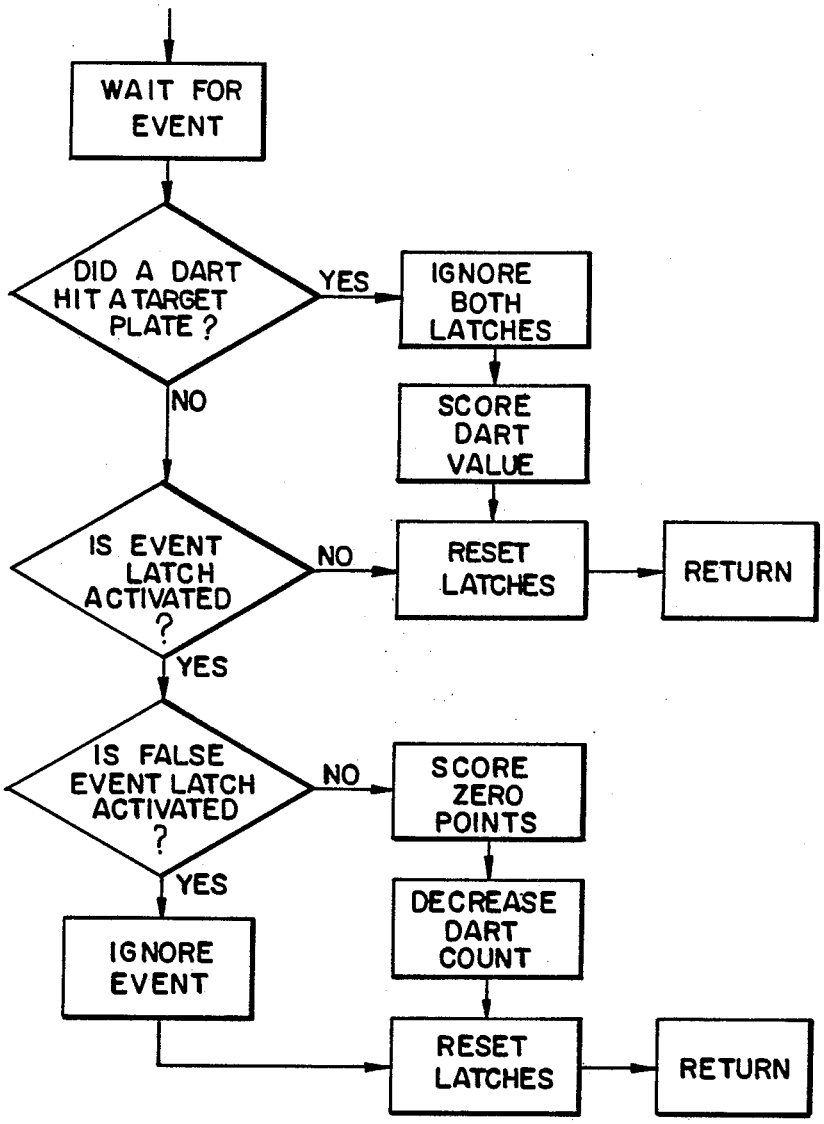
FIG. 6 is a flow diagram of a portion of a computer program in accordance with the first embodiment of the present invention employed in the scoring system of FIG. 5.

As with the first comparison means, the second comparison means in the first preferred embodiment is implemented in the scoring system 34 utilizing computer software. Alternatively, the second comparison means could be implemented by digital hardware in a manner well known in the art. FIG. 6 illustrates a basic flow diagram of one form of computer program which could be employed in connection with the electronic scoring system for use in conjunction with the missed dart detection system of the first embodiment of the present invention. It will be appreciated by those skilled in the art that the flow diagram of FIG. 6 is merely illustrative of one embodiment and that other types of flow diagrams and/or resulting computer programs could alternatively be employed. In addition, as discussed above, it will be appreciated by those skilled in the art that the functional flow diagram shown in FIG. 6 could be implemented through hardware and/or firmware rather than software.

Figure 7:
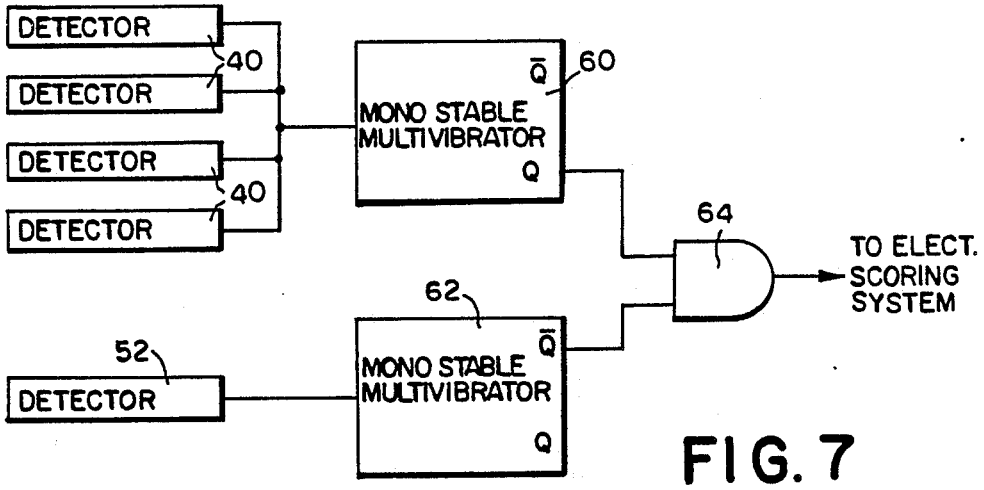
FIG. 7 is a functional block diagram of a missed dart detection system in accordance with a second embodiment of the present invention.
Figure 8:
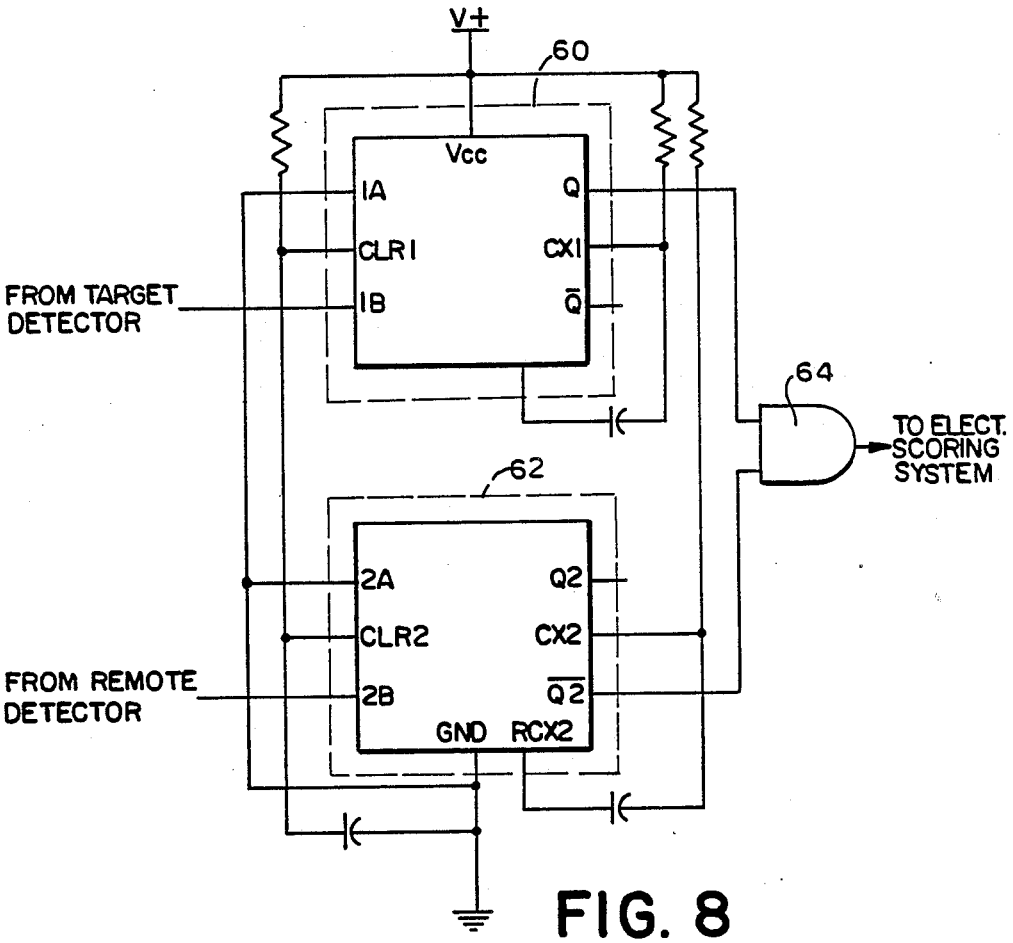
FIG. 8 is a schematic block diagram representation of a portion of the system of FIG. 7.
Figure 9:
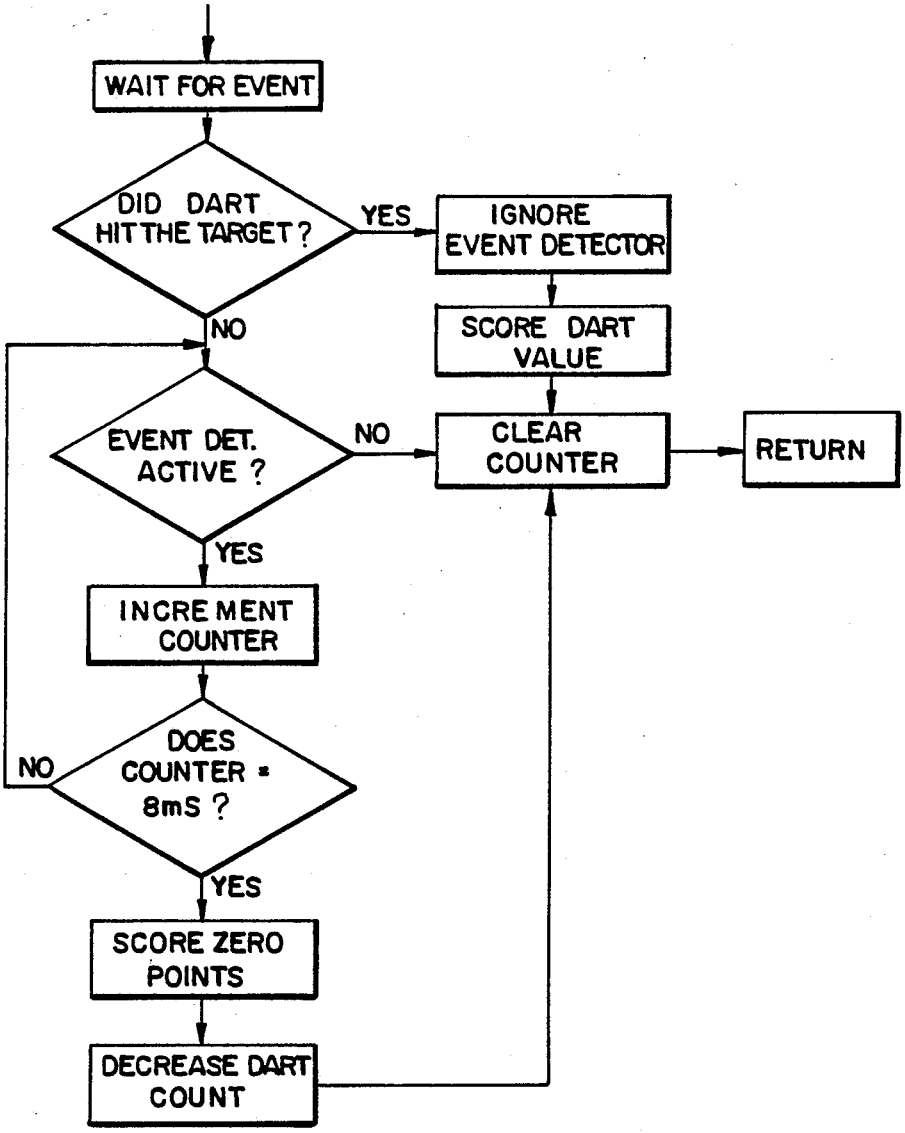
FIG. 9 is a flow diagram of a portion of a computer program in accordance with the second embodiment of the present invention employed in the scoring system of FIG. 5.

FIGS. 7–9 illustrate a second preferred embodiment of the present invention. In the second preferred embodiment, the detectors 40 and 52 are structurally and operationally the same as described above in connection with the first preferred embodiment. However, unlike the first preferred embodiment in which both the first and second comparison means were implemented within the scoring system 34, the second preferred embodiment implements the first comparison means utilizing digital hardware.

Referring now to FIG. 7, it can be seen that the outputs of each of the four detectors 40 are electrically connected to the input of a monostable multivibrator or flip-flop 60. Similarly, the output from the false event detector 52 is connected to the input of a second monostable multivibrator 62. In the presently preferred embodiment, monostable multivibrators 60 and 62 are structurally interconnected and suitably controlled utilizing biasing and timing circuitry, as illustrated in FIG. 8. A complete discussion of the structure and operation of the monostable multivibrators 60 and 62 and the biasing and timing circuitry illustrated in FIG. 8 is not necessary for a complete understanding of the present invention and, therefore, will not be presented. The design and implementation of monostable multivibrator circuitry of the type illustrated in FIG. 8 can be obtained from various component manufacturers and is generally well known to those skilled in the electronic design arts. Suffice it to say that, in general, a monostable multivibrator functions to generate an output signal for a predetermined time period in response to the receipt of an input signal. Once the predetermined time period has elapsed, no further output signal is generated by the monostable vibrator until a further input signal is received. The duration of the output signal is controlled by the timing circuitry employed with the monostable multivibrator.

In the present embodiment, monostable multivibrator 60 operates to generate a high, or positive, voltage output signal at its Q output terminal upon receipt of a positive going signal from any one of the detectors 40 at its input terminal (1B). Similarly, monostable multivibrator 62 operates to generate a low, or negative going, signal at its $\overline{Q}$ output terminal upon receipt at its input terminal (2B) of a positive going signal from the false event detectors 52. Both the Q output terminal of multivibrator 60 and the $\overline{Q}$ output terminal of multivibrator 62 are connected to a two-input AND gate 64, the output of which is connected to the electronic scoring system 34. Thus, in the presence of a signal from any one of missed detectors 40 and from false event detector 52 (indicating ambient sound), the negative going output signal from multivibrator 62 will prevent the passing of a signal through AND gate 64. On the other hand, the generation of a miss signal by any one of detectors 40 in the absence of a false event signal from detector 52 will result in a miss signal passing through AND gate 64 to the scoring system 34. In the presently preferred embodiment, the duration or pulse width of the output signal of each of the multivibrators 60 and 62 is established to be approximately 15 milliseconds. It will be appreciated by those skilled in the art that a shorter or longer pulse width may alternatively be employed.

FIG. 9 illustrates a basic flow diagram of one form of computer program which could be employed in connection with the electronic scoring system 34 for use in conjunction with the missed dart detection system of the second embodiment of the present invention. In implementing the flow diagram, an 8 millisecond counter is employed to compensate for any delay which may occur between the transition of the two multivibrators 60 and 62. While the delay employed in the flow diagram of FIG. 9 is 8 milliseconds, a shorter or longer delay time could alternatively be employed.

As discussed briefly above, the basic difference between the first and second embodiments is that the second embodiment employs digital logic for implementing the first comparison means. One advantage provided by the second embodiment is that only a single input to the electronic scoring system is employed and it is unnecessary for the electronic scoring system to provide any type of reset signal. Thus, the second preferred embodiment is simplified and is somewhat easier to implement, maintain and operate. It should be appreciated by those skilled in the art that, if desired, the second comparison means could also be implemented in digital logic circuitry.

From the foregoing description, it can be seen that the present invention comprises an electronically scored dart game having means for detecting and scoring thrown darts which miss the target. It will be appreciated by those skilled in the art that changes and modifications may be made to the above-described embodiments without departing from the inventive concepts thereof. Therefore, it is understood that the present invention should not be limited to the particular embodiments disclosed, but should include all modifications and changes which are within the scope and spirit of the invention as defined by the appended claims.

We claim:

1. In an electronically scored dart game having a housing, including a front surface, a target on the housing front surface, the target including a plurality of target plates, each target plate having a front surface including a plurality of openings for receiving the tip of a dart and having a rear surface, the target further comprising support means for supporting the target plates, the support means permitting the target plates to move rearwardly when receiving the tip of a dart within one of said openings, and electronic means for sensing the rearward movement of the target plates and for generating a score signal to determine a score in response thereto, the electronic means including display means for displaying a score, the improvement comprising:

detection means for detecting when a dart strikes the housing in the vicinity of the target, but does not strike a target plate with sufficient force to move the target plate rearwardly for a score (a missed dart), the detection means comprising:

(a) first audio sensor means located proximate the target for detecting sounds created when a dart strikes either the target or the housing in the vicinity of the target and for generating an electrical signal upon the detection of such sounds, (b) second audio sensor means located remote from the target for detecting sounds that simulate the sounds created when a dart strikes either the target or the housing in the vicinity of the target and for generating an electrical signal upon the detection of such simulated sounds; and (c) first comparison means communicating with the first and second audio sensor means for generating an electrical output signal indicative of a dart striking the target or the housing in the vicinity of the target only when an electrical signal is received from the first audio sensor means in the absence of an electrical signal from the second audio sensor means.

2. The dart game as recited in claim 1 further including second comparison means communicating with the first comparison means and with the electronic means, the second comparison means for generating an output signal indicative of a missed dart only when an output signal is received from the first comparison means in the absence of a score signal from said electronic means.

3. The dart game as recited in claim 1 wherein the first audio sensor means comprises a plurality of audio sensors at spaced locations on the housing in the vicinity of the target.

4. The dart game as recited in claim 3 wherein the target is generally circular and the first audio sensor means comprises four microphones, each microphone being located on the interior of the housing front surface, beyond the radial circumference of the target, the microphones being spaced circumferentially around the target by about 90°.

5. The dart game as recited in claim 1 wherein the second audio sensor means comprises an audio sensor located on a surface of the housing remote from the target.

6. In an electronically scored dart game having a housing, including a front surface, a target on the housing front surface, the target including means for receiving the tip of a dart, and electronic means for sensing the receipt of a dart tip by the target and for generating a score signal to determine a score in response thereto, the electronic means including display means for displaying a score, the improvement comprising:

detection means for detecting when a dart strikes the housing in the vicinity of the target, (a missed dart), the detection means comprising:

(a) first audio sensor means located proximate the target for detecting sounds created when a dart strikes either the target or the housing in the vicinity of the target and for generating an electrical signal upon the detection of such sounds, (b) second audio sensor means located remote from the target for detecting sounds that simulate the sounds created when a dart strikes either the target or the housing in the vicinity of the target and for generating an electrical signal upon the detection of such simulated sounds; and (c) first comparison means communicating with the first and second audio sensor means for generating an electrical output signal indicative of a dart striking the target or the housing in the vicinity of the target only when an electrical signal is received from the first audio sensor means in the absence of an electrical signal from the second audio sensor means.

7. The dart game as recited in claim 6 further including second comparison means communicating with the first comparison means and with the electronic means, the second comparison means for generating an output signal indicative of a missed dart only when an output signal is received from the first comparison means in the absence of a score signal from said electronic means.

8. The dart game as recited in claim 6 wherein the first audio sensor means comprises a plurality of audio sensors at spaced locations on the housing in the vicinity of the target

9. The dart game as recited in claim 8 wherein the target is generally circular and the first audio sensor means comprises four microphones, each microphone being located on the interior of the housing front surface, beyond the radial circumference of the target, the microphones being spaced circumferentially around the target by about 90°.

10. The dart game as recited in claim 6 wherein the second audio sensor means comprises an audio sensor located on a surface of the housing remote from the target.

* * * * *